United States Patent [19]

Middlemark

[11] 3,988,737

[45] Oct. 26, 1976

[54] PIVOTED ROD TELEVISION RECEIVING ANTENNA FOR INDOOR USE

[76] Inventor: Marvin P. Middlemark, 96 Store Hill Road, Old Westbury, L.I., N.Y. 11568

[22] Filed: Oct. 2, 1975

[21] Appl. No.: 618,793

[52] U.S. Cl. ..... 343/809; 343/876; 343/895

[51] Int. Cl.[2] ..... H01Q 9/44; H01Q 3/24

[58] Field of Search ..... 343/805, 809, 876, 895

[56] References Cited

UNITED STATES PATENTS

| | | | |
|---|---|---|---|
| 2,636,986 | 4/1953 | Riderman | 343/895 |
| 3,228,031 | 1/1966 | Kitamura et al. | 343/805 |
| 3,261,019 | 7/1966 | Lundy | 343/876 |

*Primary Examiner*—Eli Lieberman
*Attorney, Agent, or Firm*—S. Stephen Baker

[57] ABSTRACT

A four element television frequency antenna of the dipole type, for indoor reception use, the four dipole rods being pivotally connected to a common supporting bracket so as to be capable of different degrees of positioning, the bracket being so designed as to predetermine the usual or normal positions of reception adjustment. The antenna is of a size, bulk, and configuration to optionally enable it to be bodily horizontally disposed largely under a television receiver so as to be supported by the floor of a room. The four dipole rods are connectable to a standard selector switch structure, separate therefrom, and by which, through conventional means, various effective directivity patterns may be manually selected.

8 Claims, 4 Drawing Figures

PIVOTED ROD TELEVISION RECEIVING ANTENNA FOR INDOOR USE

BACKGROUND OF THE INVENTION

The present invention relates generally to indoor television antennas which are capable of positioning or orientation for securing maximum reception as may be required for differently located stations or other area conditions which affect reception.

To my knowledge, and except for a single, elongated, stick-like dipole connectable to the receiver by a long, flexible transmission cable, antennas of the above type are either directly built into the television receiver, or comprise a separate component, usually resting on or adjacent to the set, with a relatively short transmission line for connecting the antenna to the set. In practically all cases, the antenna elements, generally of the so-called rabbit ear type, are manually adjustable for maximum reception. This applies also when the antenna comprises only one element instead of the two element rabbit ear type. The transmission line depends directly from the terminal contact portion of the antenna, to the input contact arrangement of the receiver set. The single stick-like antenna, as referred to above, is the subject of my co-pending application, filed July 24, 1975, Ser. No. 598,573, now U.S. Pat. No. 3,961,332.

There also exist separate indoor television antennas of the above mentioned type which further employ multiple, variously extending dipole rods which are selectable in various combinations by means of a manually operable selector switch. Such a switch is well known and conventional as will be made clear hereinafter.

Many so-called outdoor television antennas employ crossed dipoles in combination with such a manually operated selector switch, the switch generally resting upon or near the receiver, and connected to the antenna by a long transmission line, whether by two pairs of flat twin conductors, or by the equivalent in co-axial cable. In either event, four conductors are employed which are respectively connected to the inner terminal ends of the four dipole rods which comprise the two crossed dipoles. Such an arrangement was specifically set forth in detail in my expired U.S. Pat. No. 2,585,670, dated Feb. 12, 1952, and has been used conventionally for both outdoor and indoor television antennas. However, such indoor antennas, to my knowledge, have not employed crossed dipoles because of space limitations. Instead, a rabbit ear type of dipole has very often been used, together with a loop, thus also comprising four inner terminal ends. Such an arrangement is typified by my design U.S. Pat. No. 194,876, dated Mar. 26, 1963.

Antenna systems of the above type, while exhibiting many advantages, have provided less than achievable reception characteristics when used as indoor antennas. It is to this problem that I directed my attention and which is the subject of this invention.

SUMMARY OF THE INVENTION

Accordingly, it is an object of the present invention to provide an indoor television antenna which comprises four dipole rods for connection to a selector switch as above described, but does not embody clumsy, prohibitively space consuming elements, as would a crossed dipole outdoor antenna.

Another object of this invention is to provide a four dipole rod indoor antenna wherein two forward dipole rods, in the shape of a V, are so physically adjacent to two aligned rear dipole rods, so that all four terminal ends may be connected to an unusually small insulation bracket. A most important feature of this bracket is that the four rods are pivotally connected thereto in such a way that the rods may virtually automatically be caused to assume a pre-determined position of orientation for maximum receptivety.

Still another object of this invention is to provide an antenna as described immediately above, which is small for practical indoor use, while nevertheless of such sturdiness and simulating the effectiveness of much larger antennas, that it can be reliably deposited directly under a television receiver without unduly protruding therefrom, or subjected to undesirably accidental dislodgement from a pre-determined over-all orientation. Indeed, the antenna may be disposed on a closet floor near the receiver should the owner so desire.

The combination bracket-rod arrangement is such that the entire antenna, i.e., the four dipole rods and the bracket, (but not including the separate selector switch), in its adjusted position of maximum receptivity, takes substantially the form of a K, the K lying sideways. This form results from the two rear, aligned dipole rods being the straight line of the K, while the V shaped forward dipole rods, with their inner terminals immediately adjacent to those of the aligned dipole rods, complete the K shape.

A further important aspect of the arrangement by which the four dipole rods are pivoted to the novel insulation bracket, is that all the rods, which are of course elongated, may be pivotally actuated so that they are all upright, parallel, and adjacent each other. This narrowed, compacted position is most useful for packing and shipping purposes.

All the above, and other objects, will become more evident from the following detailed description and specifications.

DESCRIPTION OF THE PREFERRED EMBODIMENT

The antenna comprises an insulating bracket 10 serving as a support for the four dipole rods, 11, 12, 13, and 14, all of which are pivotally connected to said bracket. It will be understood by those skilled in the art, that the dipole rods are each half of a dipole, so that rods 11 and 14 together may constitute a rearward dipole, while rods 12 and 13 together may constitute a forward dipole under certain selective actions as will hereinafter be described.

Figure 1:
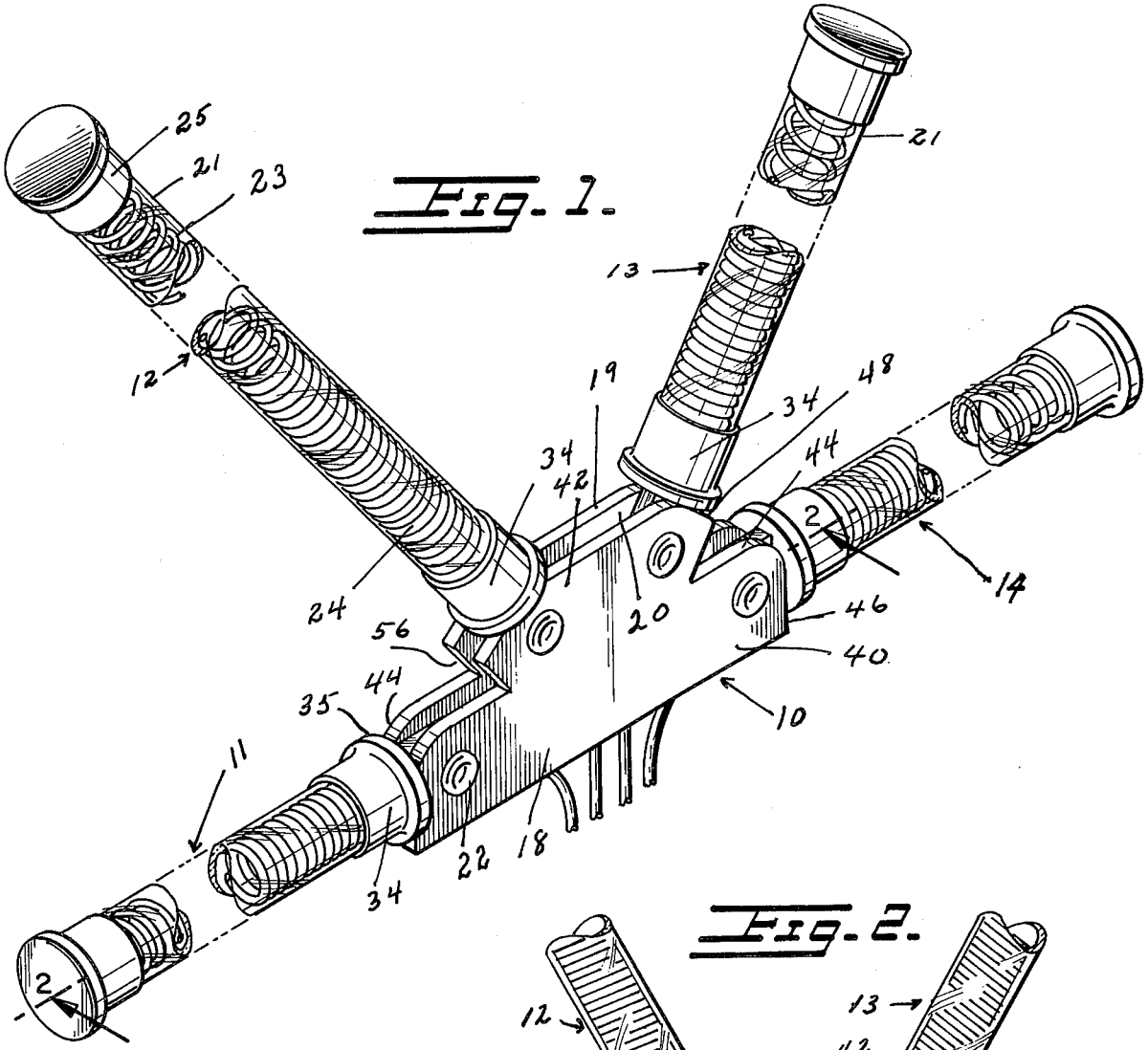
FIG. 1 is a front perspective view of the antenna, the dipole rods being shown in broken away form, to designate them to be of greater length than that illustrated.

In FIG. 1 the dipole rods are swung or pivoted on insulating rigid plastic bracket 10, to a position where it is considered that the antenna has maximum receptivity under most conditions. The general form of the antenna is then that of a K, the aligned dipole rods 11 and 14 being the straight line of the K, while the composite V shaped dipole rods 12 and 13 complete the K shape. As will be explained hereinafter, the antenna is usually so disposed or oriented in relation to the television receiver, that dipole rods 11 and 14 are rearward, somewhat similarly to a reflector in these general types of antennas, while rods 12 and 13 are forward elements. Since the antenna shown herein is designed to be flatly disposed on a supporting surface, whether under the receiver, or upon the receiver, or on any flat surface adjacent to the receiver, or concealed on the floor of a closet near the receiver the antenna may be viewed as taking the form of a K on its side. For example, if the antenna is deposited under a receiver, on the floor of a room, the rods 11 and 14 will abut the wall of the room, while the rods 12 and 13 will extend outwardly in the direction of the interior of the room.

Bracket 10 comprises two spaced opposing side walls 18 and 19, forming between them a narrow channel 20 wherein all the inner terminal ends of the dipole rods are disposed. Side walls 18 and 19 are interconnected by the four rivets 22 which also serve as pivot pins for the dipole rods.

Figure 2:
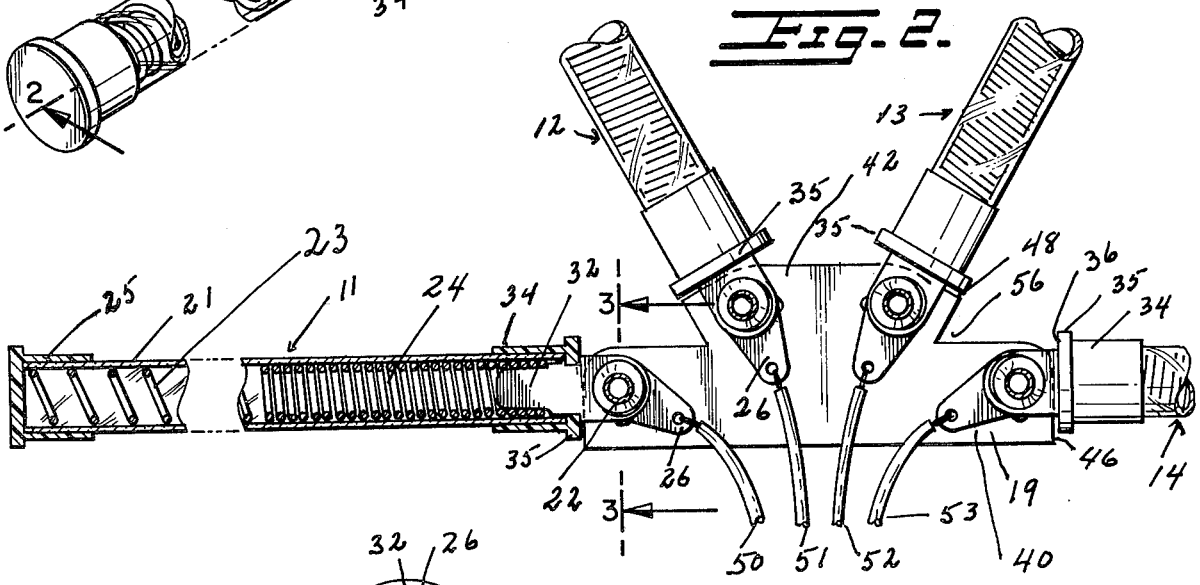
FIG. 2 is a cross-sectional view taken substantially along the line 2—2 of FIG. 1.

In the form shown, wall 19 supports the inner terminal ends of the dipole rods as shown in FIG. 2, and as will hereinafter be made clear.

The dipole rods themselves will now be described. Esssentially they are not of novel construction but with some mechanical mounting structure as will be described, they provide advantages in the best form of the antenna as I have devised it.

All the rods are alike. They comprise rigid, tubular, plastic, elongated bodies 21 which are illustrated as transparent, mainly for aesthetic reasons. As an example, the thickness of the plastic is about 1/16 inch. The length of each rod is about 20 inch. Its diameter is about 9/16 inch. These dimensions are to be understood as being simply representative.

Entirely disposed within each body 21 is a metal dipole section 23. In the form shown, sections 23 are of coiled spiral form which provides them with some inductance helping to permit some shortening of length relative to generally employed rabbit ear wands. This aspect is not new, nor are the more compacted inner ends 24 thereof. Such compacted inner ends merely serve to facilitate the connection of the rods to the bracket 18. The wire used for forming the coiled, electrically conductive sections 23 is not at all critical, usually being of resilient metal of about 1/32 inch diameter and coated with insulation. An outer end cap 25, which may be of resilient plastic is frictionally fitted over the outer ends of the bodies 21.

Figure 3:
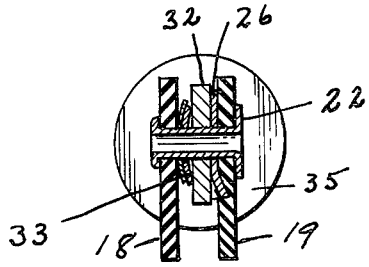
FIG. 3 is a cross-sectional view as taken along the line 3—3 of FIG. 2, although somewhat enlarged.
Figure 4:
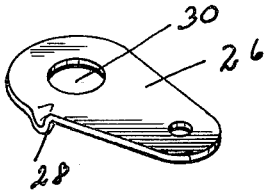
FIG. 4 is a perspective view of the bracket which connects the dipole rods to the selector switch wires.

Fixedly secured against the inner face of bracket wall 19 is a conducting bracket 26. Any means of fixation may be employed, but I have shown a small tongue 28 which fits snugly into a small depression formed in wall 19, as shown in FIG. 3. Hole 30 is designed to admit rivet 22 therethrough.

The pivotal action of the dipole rods is accomplished by flat metal rod 32 the rear end of which is pivotable around rivet 22. The front end of rod 32 enters into tubular dipole section 23 where it is firmly and fixedly held by the compacted coil end of section 23 in electrically conductive relationship. Also disposed on rivet 22 are a pair of spring washers 33 which serve to provide a positive pivoting action such as to prevent displacement from an adjusted position of the dipole rods.

A plastic cap 34, similar in form to outer cap 25, is frictionally fitted on the inner end of each dipole rod so as to support the rod, although some support function is provided by rod 32. Cap 34 is normally about ½ inch in diameter, and being of resilient plastic, fits snugly over dipole body 21. The circular rim 35 of the end wall 36 of cap 34 is about 1/16 inch thick. The function of cap 34, and particularly of the rim 35 and the end wall 36 is of importance as will hereinafter be made clear. Cap 34 is formed with a slot as shown in FIG. 2, so as to admit and very firmly grasp metal rod 32.

The shape of bracket 10 is of importance for proper physical co-action with rims 35 and end walls 36 of inner caps 34. The walls of bracket 10 may be considered as comprising a lower rectangularly shaped horizontally elongated portion 40, with an integral crown portion 42.

Considering first lower bracket portion 40, it has rounded shoulders 44, and straight sides 46. Since cap 34 firmly grasps rod 32, the cap rim 35 frictionally engages sides 46, and shoulders 44, about which it nevertheless may pivot. It should be noted that sides 46 and shoulders 44 therefore function as peripheral camming ends or edges so as to positively guide the pivotal travel of caps 34. Thus, when cap 34, and of course its connected dipole rod, are pivoted into functional position, the caps 34 are precisely brought into horizontal, aligned position, by sides 46 as shown in FIGS. 1 and 2.

Now, considering crown portion 42 of bracket 10, the central portion of its extreme upper edge is substantially straight. Its ends, 48, however, are downwardly inclined. Thus they similarly serve as camming ends for the pivotal travel of dipole rods 12 and 13 to their maximum and presumably most desirable position of orientation. When their inner caps 34 reach the ends 48 of crown 42, they are intercepted and can travel no further. This rest position assures the desired K formation adjustment.

The electrical connection of the antenna to a television receiver will now be explained. First, it will be noted that four wires 50, 51, 52, and 53, are connected to the respective brackets 26, thus establishing individual connection to each dipole rod. The four wires may take the form of two lengths of flat, twin conductor transmission lines, or two conventional co-axial cables, whichever is preferred. It may be observed generally, that flat line has a 300 ohm impedance, while co-axial cable is about 72 ohms. Those skilled in the art will make the choice.

The antenna as above described may be used without a selector switch by connecting wires 51 and 52 to the input system of a television receiver. In such case, the dipole rods 11 and 14 will function as a reflector, and may be shorter together or not, i.e. by connecting wires 50 and 53, or not, this aspect making little difference since a reflector is parasitic. This arrangement, while it simulates conventional outdoor antennas, is critically different physically since a reflector is ordinarily spaced, at the VHF range, almost three feet from the forward elements. This is entirely impractical for indoor antennas. However, there is virtually no spacing in the antenna as described herein and indoor usage is made practical.

Nevertheless, it is far better to connect the wires 50–53, individually, to a selector switch as exactly set forth in my prior U.S. Pat. No. 2,585,670, and as has become conventional in the indoor television antenna art.

Thus, referring to my said U.S. Pat. No. 2,585,670, FIG. 1 thereof shows four wires (24 to 27) connected to the four dipole rods and thence to the selector switch. The four wires 50–53 of this application are connected the same way, to the same or an equivalent switch. By "equivalent" I mean a switch which may differ in appearance or style; not in construction or function. The switch housing is not functional in shape and may assume various shapes.

The action of a selector switch as exactly set forth in my said prior patent is automatic as the switch is manually operated as is explained therein and as is conventional. However, I can summarize the action by pointing out that the switch has nine positions resulting as follows:

1. Dipole rods 11 and 12 are connected to the receiver, while rods 13 and 14 remain free and serve as a reflector, whether shorted or not.
2. Dipole rods 11 and 13 are connected to the receiver; rods 12 and 14 are free.
3. Dipole rods 11 and 14 are connected to the receiver; rods 12 and 13 are free, etc.
4. Dipole rods 12 and 13 are connected to the receiver, etc.
5. Dipole rods 12 and 14 are connected to the receiver, etc.
6. Dipole rods 13 and 14 are connected to the receiver, etc.
7. Dipole rods 11 and 12 are connected together at their terminals. A second junction is made by similarly connecting together dipole rods 13 and 14. The two junctions go to the receiver input.
8. Dipole rods 11 and 13, and rods 12 and 14, are connected as explained in position 7.
9. Dipole rods 11 and 14, and rods 12 and 13, are connected as explained in position 7.

As I have pointed out above, bracket 10 is so formed as to permit all four dipole rods to be swung upwardly to a mutually adjacent, parallel inter-relationship to a narrowed, compacted position, for packing and shipping purposes. Thus the rims 35 of the inner supporting caps 34 for dipole rods 12 and 13 will rest flatly, centrally on crown portion 42. On the other hand, the similar supporting caps 34 of the dipole rods 11 and 14, will ride along shoulders 44 and their rims 35 will become lodged and virtually locked into the two opposing notches 56 formed at the sides of the bracket 10. As stated above, this position is of course not the functioning position of the antenna.

The K shaped, functioning antenna as shown, may be flatly deposited under, upon, or adjacent the television receiver, or quite practically be concealed in a closet, etc., with the wires 50–53 extending therefrom to a selector switch as above described, the switch housing usually resting on, or being fastened to the receiver cabinet.

In an operating embodiment, the dipole rods were 20 inches, the length of the bracket 10 was 3¼ inches, its height was 1½ inches, the spacing between its two sides was ⅛ inch, the diameter of the rods was 9/16 inch, with the plastic tubular bodies 21, 1/16 inch thick. The complete length of each transmission wire 50–53, was five feet, to the base of a selector switch. Of course, these are simply representative figures, given only as an example.

I have shown a preferred embodiment of my invention but it is obvious that numerous changes and omissions may be made therein without departing from its spirit.

What is claimed is:

1. An indoor television antenna comprising insulating supporting means, at least four dipole rods connected to said supporting means, and all mutually insulated thereon two of said dipole rods serving as a rearward dipole and said two dipole rods being in alignment and having their inner terminal ends connected to said supporting means, the other two dipole rods being together V-shaped, with their inner terminal ends also connected to said supporting means, all four inner terminal ends being immediately adjacent each other so that the four dipole rods substantially take the form of a K on its side.

2. An indoor television antenna according to claim 1 and wherein said supporting means constitute a plastic bracket, and said dipole rods all being pivotally connected to said bracket so that they may be pivoted to said K form.

3. An indoor television antenna according to claim 2 and wherein said bracket comprises a lower rectangularly shaped horizontally elongated portion, and an integral crown portion thereof, both of said bracket portions having peripheral camming end edges, and dipole rod support members disposed at the inner ends of said dipole rods, said support members physically co-acting with respective bracket camming end edges during pivoting action of said dipole rods, so that all said rods may come to a predetermined rest position where they assume said K form.

4. An indoor television antenna according to claim 2, and four wires respectively connected to the rod inner terminal ends, whereby different ones of said wires may be selected in various combinations for effective connection to the input terminals of a television receiver.

5. An indoor television antenna according to claim 4 and wherein said bracket comprises two spaced opposing walls forming a narrow channel therebetween, a metal rod electrically and fixedly connected to each dipole rod inner terminal end, all of said metal rods being swingably connected to said bracket within said channel, and said metal rods being at all times respectively connected to said four wires.

6. An indoor television antenna according to claim 5 and wherein each of said dipole rods comprises a tubular plastic elongated body, and coiled metal members extending throughout said tubular bodies, whereby the entire antenna is of a weight substantially greater than were the rods to be straight metal wands so that the entire antenna may rest more securely of its own weight on a supporting surface therefor.

7. An indoor television antenna according to claim 6 and including outer end caps frictionally fitted to the outer ends of said tubular bodies.

8. An indoor television antenna according to claim 7 and wherein said bracket comprises a lower rectangularly shaped horizontally elongated portion, and an integral crown portion thereover, both of said bracket portions having peripheral camming ends, dipole rod support caps on the inner ends of said dipole rods, said caps having inner end walls which physically co-act with respective bracket camming ends during pivoting action of said dipole rods, so that all of said rods may come to a predetermined rest position where they assume said K form.

* * * * *